US008707717B2

(12) United States Patent
Fox et al.

(10) Patent No.: US 8,707,717 B2
(45) Date of Patent: Apr. 29, 2014

(54) METHOD FOR OPERATING A COOLING DEVICE FOR COOLING A SUPERCONDUCTOR AND COOLING DEVICE SUITABLE THEREFOR

(75) Inventors: Falko Fox, Kiel (DE); Alexander Peetz, Nürnberg (DE); Heinz Schmidt, Möhrendorf (DE); Peter Van Hasselt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 71 days.

(21) Appl. No.: 13/391,189

(22) PCT Filed: Aug. 17, 2010

(86) PCT No.: PCT/EP2010/061966

§ 371 (c)(1), (2), (4) Date: Mar. 7, 2012

(87) PCT Pub. No.: WO2011/020828

PCT Pub. Date: Feb. 24, 2011

(65) Prior Publication Data

US 2012/0159975 A1 Jun. 28, 2012

(30) Foreign Application Priority Data

Aug. 21, 2009 (DE) ..... 10 2009 038 308

(51) Int. Cl.
*F25B 1/00* (2006.01)

(52) U.S. Cl.
USPC ..... 62/115; 62/498

(58) Field of Classification Search
USPC ..... 62/115, 129, 157, 498, 457.9, 226, 6, 62/50.3; 318/799, 805, 807, 808
See application file for complete search history.

(56) References Cited

U.S. PATENT DOCUMENTS

| | | | | |
|---|---|---|---|---|
| 3,638,088 | A * | 1/1972 | Jonsson | 318/809 |
| 5,130,628 | A * | 7/1992 | Owen | 318/780 |
| 5,245,830 | A | 9/1993 | Aubrun | |
| 5,342,176 | A | 8/1994 | Redlich | |

(Continued)

FOREIGN PATENT DOCUMENTS

| | | | |
|---|---|---|---|
| DE | 19952578 | B4 | 11/2005 |
| DE | 602004005418 | T2 | 11/2007 |

(Continued)

OTHER PUBLICATIONS

German Priority Document DE 10 2009 038 308.5.
International Search Report.

*Primary Examiner* — Mohammad M Ali
(74) *Attorney, Agent, or Firm* — Harness, Dickey & Pierce, P.L.C.

(57) ABSTRACT

A cooling device is disclosed for cooling a superconductor, wherein the cooling device includes a linear compressor for compressing a working medium and a cooling unit for providing a cooling power to a cryogenic coolant of the superconductor by expanding the working medium. The linear compressor includes two pistons of which at least one, preferably both synchronously relative to each other, are displaceable at a frequency and a stroke linear to the other piston, wherein a defined cooling power can be generated at a good efficiency so that the cooling device is suitable for use particularly in mobile installations, such as ships. To this end, according to at least one embodiment of the invention, the stroke of the at least one displaceable piston is controlled at a preferably prescribed target value.

19 Claims, 4 Drawing Sheets

(56) References Cited

U.S. PATENT DOCUMENTS

| | | | | |
|---|---|---|---|---|
| 5,359,520 | A | 10/1994 | Aubrun et al. | |
| 5,419,255 | A * | 5/1995 | Reffert | 101/463.1 |
| 5,535,593 | A | 7/1996 | Kieffer | |
| 5,980,211 | A | 11/1999 | Matsumura | |
| 6,289,680 | B1 | 9/2001 | Oh et al. | |
| 7,550,941 | B2 | 6/2009 | Dainez et al. | |
| 2002/0093327 | A1 | 7/2002 | Hwang | |
| 2007/0286751 | A1 * | 12/2007 | Manole et al. | 417/417 |
| 2008/0002443 | A1 * | 1/2008 | Ueda et al. | 363/126 |

FOREIGN PATENT DOCUMENTS

| | | | |
|---|---|---|---|
| JP | H1096563 | A | 4/1998 |
| JP | 11132585 | A | 5/1999 |
| JP | 11304270 | A | 11/1999 |
| JP | 2001255034 | A | 9/2001 |
| JP | 2003185281 | A | 7/2003 |
| JP | 2003185284 | A | 7/2003 |
| JP | 2004108678 | A | 4/2004 |
| JP | 2005094882 | A | 4/2005 |
| JP | 2007014144 | A | 1/2007 |

* cited by examiner

METHOD FOR OPERATING A COOLING DEVICE FOR COOLING A SUPERCONDUCTOR AND COOLING DEVICE SUITABLE THEREFOR

PRIORITY STATEMENT

This application is the national phase under 35 U.S.C. §371 of PCT International Application No. PCT/EP2010/061966 which has an International filing date of Aug. 17, 2010, which designates the United States of America, and which claims priority on German patent application number DE 10 2009 038 308.5 filed Aug. 21, 2009, the entire contents of each of which are hereby incorporated herein by reference.

FIELD

At least one embodiment of the invention generally relates to a method for operating a cooling device for cooling a superconductor and/or a cooling device.

BACKGROUND

A cooling device is known from, for example, U.S. Pat. No. 5,535,593 A.

In electrical devices or machines comprising superconductors, such as for example motors, generators or superconducting current limiters, the superconductor has to be cooled and to this end is generally located in a cryostat which contains a cryogenic coolant, such as for example liquid neon or liquid nitrogen. In this case, a cooling device serves for recondensing evaporated coolant present in the cryostat. The cooling device, frequently also denoted as a refrigerator, generally comprises a closed circuit in which a working medium, for example helium gas, is compressed in a compressor and expanded again in a cooling unit and, as a result, discharges cooling power to the coolant located in the cryostat. The cooling device may, for example, operate according to the Gifford McMahon principle, according to the pulse tube principle or according to the Stirling principle.

Due to their high power density, small space requirement and other specific properties of the superconductor, electrical devices or machines comprising superconductors are eminently suitable for use in mobile devices, such as for example in ships or offshore platforms. Thus DE 10 2004 023 481 A1 and WO 03/047961 A2 disclose marine propulsion machines and generators comprising a rotor with a rotating high-temperature superconductor field winding, which is arranged in a cryostat in which neon is located at a temperature of 25 K as coolant for the superconductor. The cryostat is connected via a cryo-heat pipe to a cold head of a cooling device to which a compressor also belongs.

A short-circuit current protection system for ships and offshore installations comprising a superconducting current limiter is disclosed in EP 1 526 625 A1, in which the superconductor is arranged in a cryostat, in which liquid nitrogen is located at a temperature of 77 K as coolant for the superconductor. A cooling device serves for recondensing evaporated coolant, said cooling device comprising a cold head protruding into the cryostat and a compressor. The cooling device itself is not able to be regulated, but the regulation takes place indirectly by a reheating device which is attached to the cold head. The reheating device is switched on and off by a temperature regulating device, so that the temperature of the liquid nitrogen at 77 K is at ambient pressure. Due to its low maintenance requirement, an oil-free linear compressor is preferably used as the compressor.

For the use of electrical devices or machines comprising superconductors in mobile devices, in particular on ships or offshore platforms, care has to be taken that the operation of the cooling device is also able to be ensured in an inclined position of the components. Thus, for example, for use on ships, operation also has to be ensured at an inclined position of 22.5 degrees.

Compressors operating according to the reciprocating piston principle or helical compressors, are not suitable in this case, as they are lubricated by oil and therefore are not able to be inclined in operation. Oil-free linear compressors are, however, suitable. Such a linear compressor generally comprises two pistons of which at least one, preferably both synchronously relative to one another, is and/or are able to be moved by a linear motor at a frequency and a stroke in a linear manner relative to the respective other piston.

It is known in this case to control the power of such a compressor manually or automatically by varying the motor voltage and the piston frequency. As has been proven, however, such a control method is not suitable for ships as, for example, it does not take into account dependencies of the resonance frequency of the pistons on the filling pressure in the circuit and the temperature of the working medium. Moreover, an inclination or oblique position of the compressor also leads to a shifting of the operating point of the compressor. This has the result, firstly, that a defined cooling power is not able to be set. Secondly, this has the result that operating points are set at which the cooling device operates at a very poor level of efficiency and has a relatively high requirement for electrical energy. Shifting the operating point may also result in the risk of the pistons striking a housing of the compressor and thus to safety cut-outs of the compressor.

SUMMARY

At least one embodiment of the present invention provides a method for operating a cooling device, by which a defined cooling power may be produced with a high level of efficiency, so that the cooling device is suitable, in particular, for use in mobile devices, such as for example ships.

Moreover, at least one embodiment of the present invention provides a cooling device which is suitable for carrying out the method.

Advantageous embodiments of the method in each case form the subject matter of the sub-claims. Advantageous embodiments of the cooling device in each case form the subject matter of sub-claims.

In the method according to at least one embodiment of the invention, the stroke of the at least one movable piston is regulated at a preferably predeterminable target value. The phrase "stroke of a piston" is understood here as the path which the piston covers from a first dead centre point (reversal point) of its reciprocating movement to a second dead center point (reversal point). By regulating the stroke in such a manner, a fixed operating point of the cooling device may be set, irrespective of the temperature, the filling pressure of the working medium and other influences, such as for example an oblique position of the compressor. By using the piston stroke and the frequency, it is possible to draw an accurate conclusion about the cooling power produced. Thus an operating point may be specifically set at which a defined, in particular predeterminable, cooling power is produced with a good level of efficiency. A cooling device operated in such a manner is thus particularly suitable for use in mobile devices, such as for example ships.

For an accurate and powerful drive of the, or each, movable piston, the cooling device preferably comprises in each case an electric motor and a frequency converter for supplying the motor with electrical current at a predeterminable voltage and frequency.

Thus, in at least one embodiment, the cooling device comprises two movable pistons which may be driven via one respective frequency converter by one respective electric motor at a frequency-synchronous voltage, wherein the motors are configured as two-phase AC motors and the frequency converters are configured as three-phase converters with a voltage intermediate circuit, wherein the converters on the input side may be connected to a three-phase network and on the output side via two phases to the respective motor, and wherein an additional capacitor is arranged in parallel with the voltage intermediate circuits.

According to an advantageous embodiment, the target value for the stroke may be deduced from a target value for the cooling power and by regulating the stroke at a predeterminable target value, the cooling power may be controlled and/or regulated at said target value.

In two reciprocating pistons moving synchronously relative to one another in a linear manner, an average value from the stroke of the two pistons may be used as a controlled variable for regulating the piston stroke.

If the or each movable piston is driven by one respective motor, the piston stroke may be regulated very accurately by the voltage applied to the respective motor being used as a manipulated variable for regulating the piston stroke, for example in the form of an offset in the manipulated variables thereof (for example by a DC voltage component in the motor voltage).

A cooling device according to at least one embodiment of the invention for cooling a superconductor comprises a linear compressor for compressing a working medium and a cooling unit for discharging a cooling power to a cryogenic coolant of the superconductor by expanding the working medium, wherein the linear compressor comprises two pistons, of which at least one, preferably both synchronously relative to one another, is or are able to be moved at a frequency and a stroke in a linear manner relative to the respective other piston. In this case, the cooling device comprises a regulating device which is designed so that it regulates the stroke of the at least one movable piston at a preferably predeterminable target value.

Preferably, data are stored in the regulating device which describe a connection between the cooling power and the piston stroke.

According to a particularly advantageous embodiment, the cooling device comprises a superimposed control and/or regulating device for controlling and/or regulating the cooling power at a predeterminable target value by regulating the piston stroke.

The regulating device may comprise a measuring device, preferably a magnetic field sensor or an optical sensor, for measuring the piston stroke of the at least one movable piston.

An automatic adjustment of an operating point at optimal efficiency is possible by the regulating device being designed so that when regulating the piston stroke it determines a resonance frequency of the reciprocating movement and sets the frequency of the reciprocating movement to the resonance frequency.

BRIEF DESCRIPTION OF THE DRAWINGS

The invention and further advantageous embodiments of the invention according to features of the sub-claims are described in more detail hereinafter with reference to exemplary embodiments in the figures, in which:

DETAILED DESCRIPTION OF THE EXAMPLE EMBODIMENTS

Figure 1:
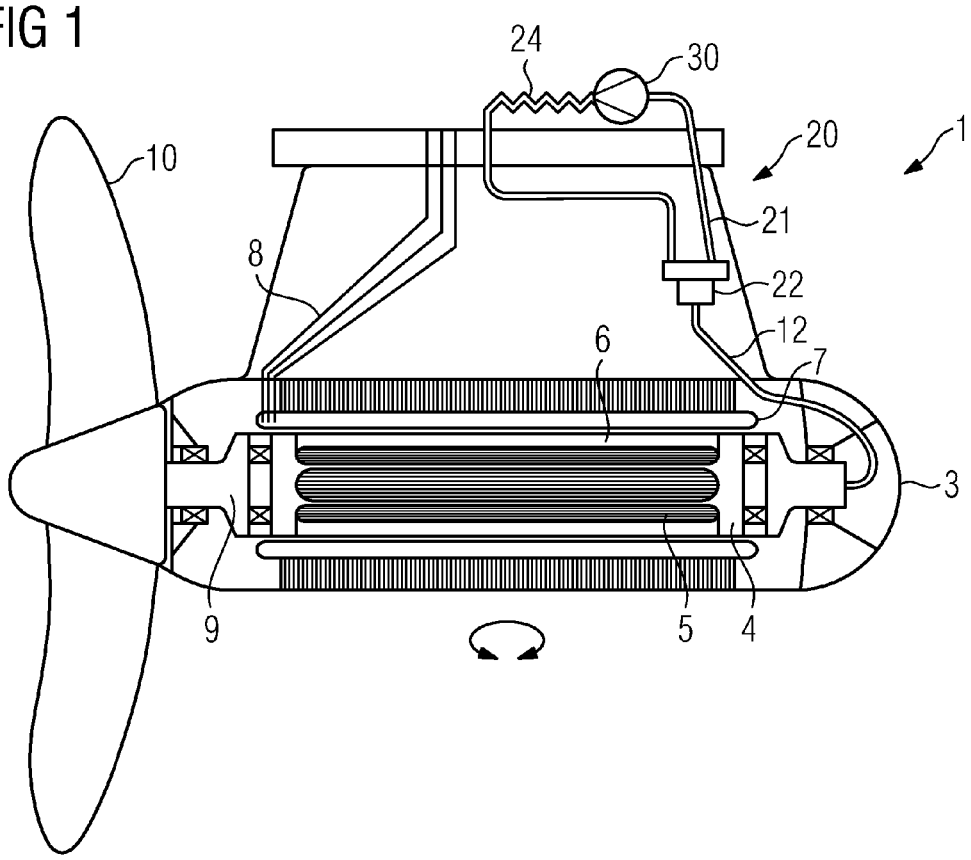
FIG. 1 shows an example of a marine propulsion system comprising a motor with a superconductor.

A marine propulsion system 1 shown in FIG. 1 and known from the prior art comprises a high-temperature superconductor motor (HTS motor) 2 which is arranged in a gondola 3 outside the actual ship's hull and is also denoted as a pod drive. The HTS motor 2 may, however, also be located inside the ship. The HTS motor 2 comprises a rotor 4 with a rotating high-temperature superconductor field winding 5, which is arranged in a cryostat 6, in which neon at a temperature of 25 K is located as coolant for the superconductor. The rotor 4 is surrounded by a stator 7. An air gap is located therebetween. Current is supplied to the HTS motor 2 via electrical cables 8. The HTS motor 2 is connected to a propeller 10 via a propeller shaft 9.

The cryostat 6 is connected via a cryo-heat pipe 12 to a cooling unit 22 of a cooling device 20. The cooling device 20 comprises a closed thermodynamic circuit 21 for a working medium, in which in addition to the cooling unit 22 an oil-free linear compressor 30 and a heat exchanger 24 are also arranged. In the circuit 21, the working medium is compressed in the compressor 30, cooled in the heat exchanger 24 and expanded in the cooling unit 22 and, as a result, discharges cooling power to the coolant of the superconductor. Coolant evaporated in the cryostat 6, is supplied to the cooling unit 22 via the cryo-heat pipe 12 and recondensed again on a cooled surface of the cooling unit 22.

If the cooling device 20 operates according to the Gifford McMahon principle, the cooling unit 22 is a so-called cold head. Helium gas is used, for example, as the working medium. The cooling device, however, may also operate, for example, according to the pulse tube principle or according to the Stirling principle.

Figure 2:
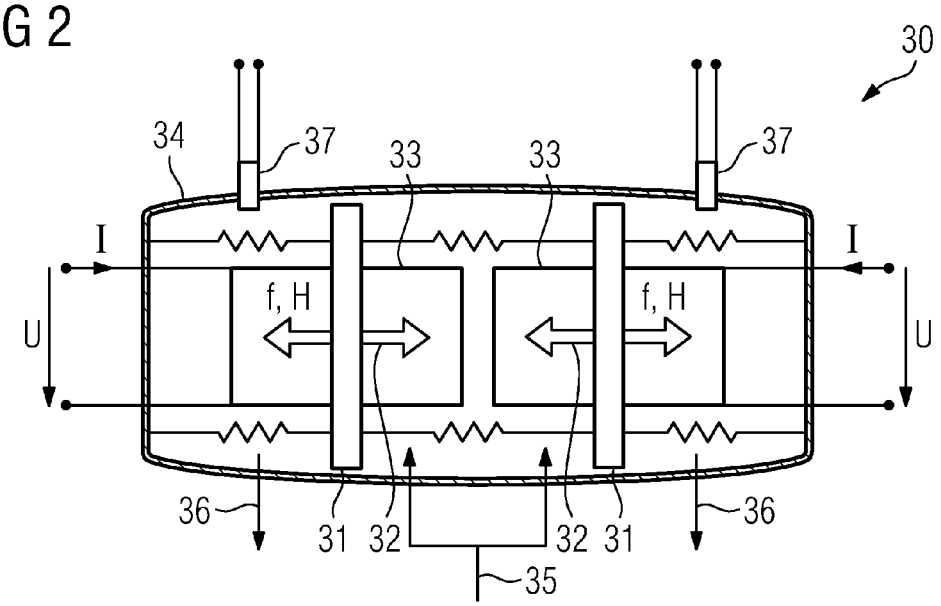
FIG. 2 shows a schematic section through a linear compressor.

Further details of the linear compressor 30 are shown schematically in FIG. 2. The linear compressor 30 comprises two pistons 31, which are movable in a housing 34 in the direction denoted by the arrows 32, in a linear manner relative to one another at a frequency f and a stroke H relative to the respective other piston 31. In a variant, one of the two pistons 31 may also be held in a stationary manner and only the other piston 31 is able to be moved toward said piston in a linear manner at a frequency f and a stroke H.

The two pistons 31 are driven in each case by a linear motor 33. Due to the movement of the pistons, Helium gas which has a low pressure, is sucked in via a supply line denoted by 35. The sucked-in Helium gas is compressed by the pistons 31 and ejected again via discharge lines denoted by 36.

On the input side, a two-phase motor voltage U is applied to the motors 33, said motor voltage producing a motor current I.

Figure 3:
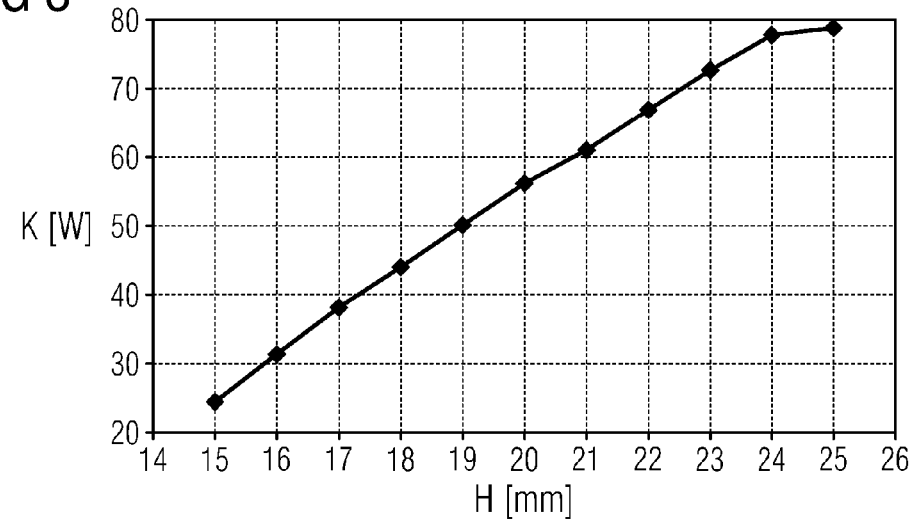
FIG. 3 shows a diagram with a view of the dependency of the cooling power on the piston stroke.

According to an embodiment of the invention, the stroke of the two pistons 31 is regulated at a predeterminable target value. The target value for the stroke is in this case deduced from a target value for the cooling power, which has to be discharged by the cooling unit 22 to the coolant, in this case neon, for the superconductor 5. By way of example, the diagram of FIG. 3 shows the connection between the cooling power K and the stroke H at a constant frequency f of the reciprocating movement of the pistons 31. As is visible, the cooling power K rises with the increasing stroke H of the pistons 31. By regulating the stroke H of the pistons 31, therefore, the cooling power may be controlled and/or regulated at a target value.

For determining the stroke of the pistons 31, a measuring device 37 for determining the stroke of the respective piston 31 is arranged inside the linear compressor 30 on each of the two pistons 31. The measuring device 37 is preferably a magnetic field sensor (for example a Hall sensor) or an optical sensor (for example a laser diode).

Figure 4:
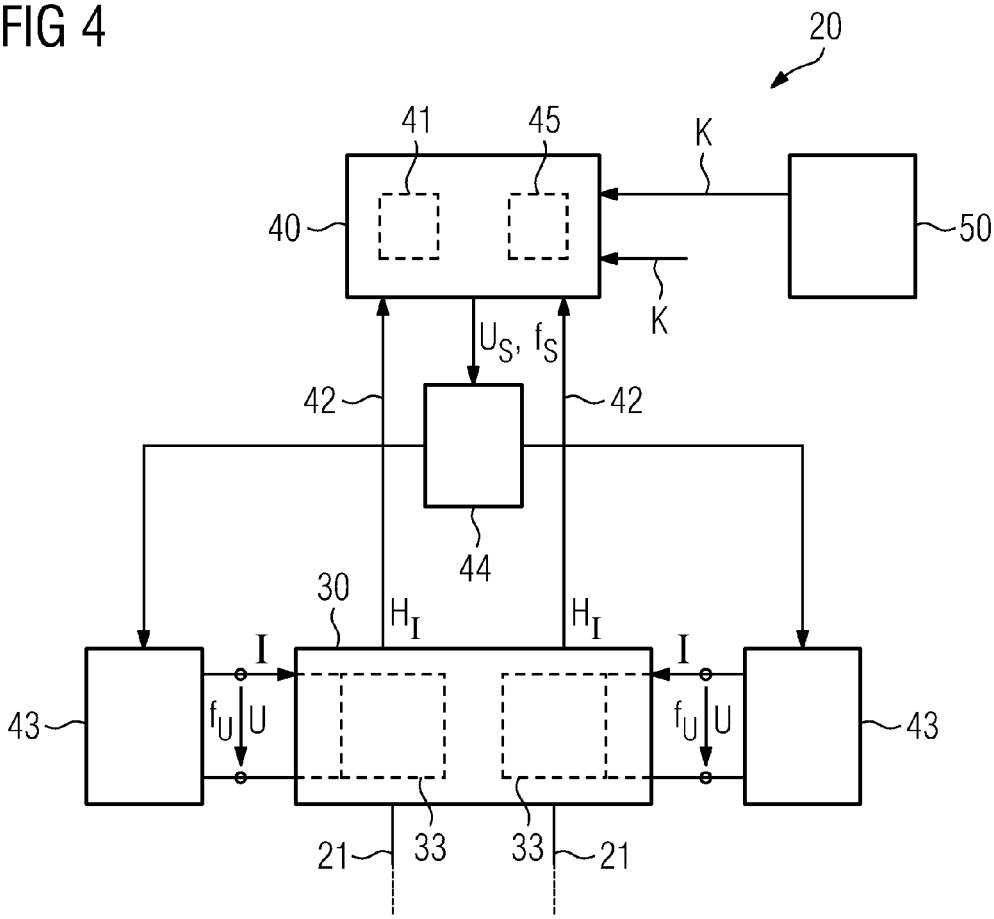
FIG. 4 shows components for the actuation and regulation of the linear compressor.

Further components of the cooling device 20 for regulating and actuating the linear compressor are shown in FIG. 4. A regulating device 40 is designed such that it regulates the stroke of the pistons 31 at a predeterminable target value. The regulating device 40 receives a target value K for the cooling power either manually from an operator or from a superimposed control and/or regulating device 50 for controlling and/or regulating the cooling power. In the regulating device 40, target values for the stroke of the pistons 31 and the frequency of the reciprocating movement of the pistons 31 are deduced from said target value. To this end, data 41 are stored in the regulating device 40 which describe a connection between the cooling power, the piston stroke and the resonance frequency. It is possible, if required, for these connections to have been determined previously as a result of experiments.

In each case, a frequency converter 43 serves for supplying the linear motors 33 with a predeterminable voltage U of the frequency fu. A control and/or regulating unit 44 serves for controlling and/or regulating the frequency converters 43.

An average value from the stroke of the two pistons 31 is used as a controlled variable for regulating the piston stroke. To this end, the regulating device 40 detects actual values for the piston positions from the measuring devices 37 via signal lines 42 and determines therefrom an average value of the stroke of the two pistons 31. The output signals of the measuring device 37, for example a voltage, are measured via at least one period of the stroke, i.e. one complete reciprocating movement.

Figure 5:
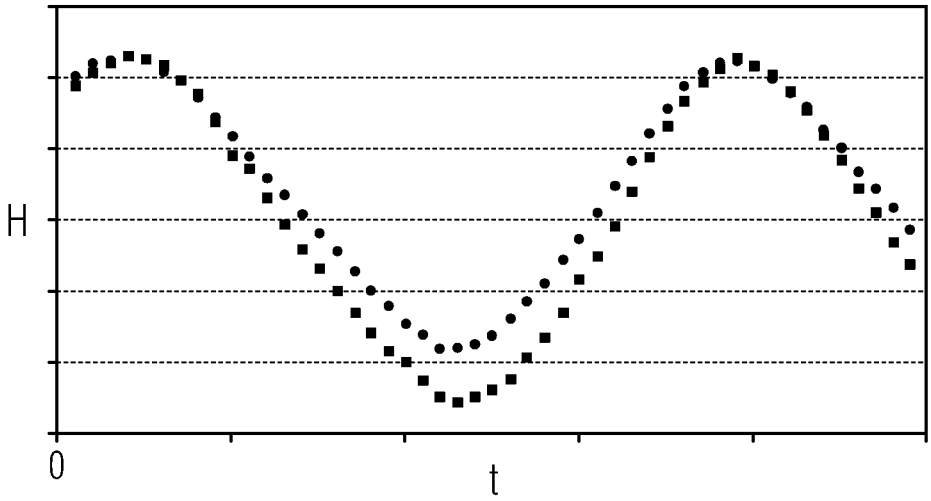
FIG. 5 shows a diagram with measured values for the stroke of the pistons of a linear compressor.

In this case, the stroke of the two pistons is determined from a difference between the two dead center points of the pistons, in which they reverse their direction of movement, in a period of reciprocating movement. To this end, by way of example, FIG. 5 shows different measured values, which exhibit the path of the stroke H over the time t for the two pistons 31 in a period of one reciprocating movement. From these measured points, the minimum and maximum piston stroke of each piston 31 and thus the stroke thereof is calculated per period.

Figure 6:
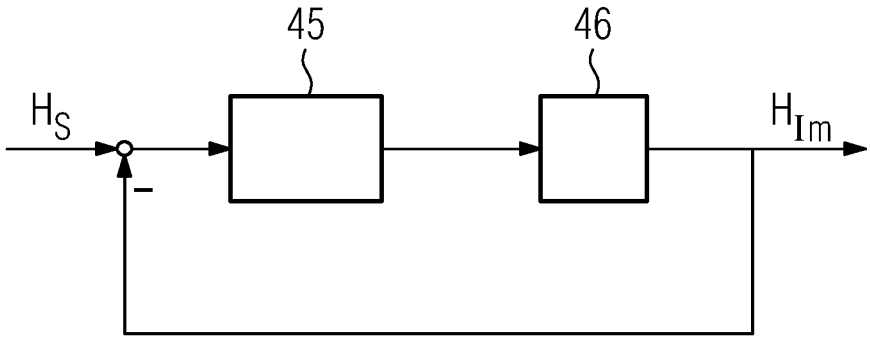
FIG. 6 shows a block diagram of the regulating process.

The average value from the stroke of the two pistons per period produces an actual value HIm, which is supplied to a regulator 45 of the regulating device 40. To this end, FIG. 6 shows a block diagram of the regulating process, with the regulator 45 and the regulating path 46. The regulator 45 determines from the difference between the actual value HIm for the piston stroke and a target value HS for the piston stroke, a manipulated variable, in this case a target value US, for the motor voltage U which is transferred from the regulating device 20 together with a target value fs for the frequency of the motor voltage to the control and/or regulating unit 44 of the frequency converters 43. The control and/or regulating unit 44 thus controls and/or regulates the output voltage of the two frequency converters 43 at the required target values US and fs, wherein the two linear motors 33 are supplied with a frequency-synchronous voltage.

The regulator 45 is, for example, an I-regulator. The precise construction of the regulator 45 is preferably carried out after an evaluation of the step responses of the regulating path and the guide behavior of the entire system.

Figure 7:
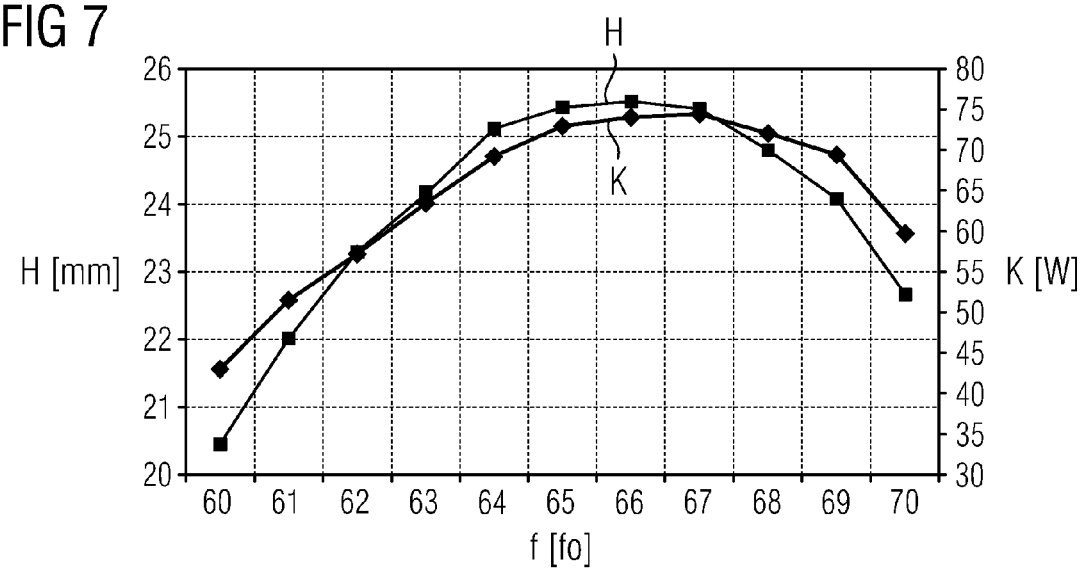
FIG. 7 shows a diagram with a view of the dependency of the cooling power and the stroke on the frequency.

Motor voltages U applied to the motors 31 are used, therefore, as manipulated variables for regulating the piston stroke. In this case, when regulating the piston stroke the frequency of the reciprocating movement may be fixedly predetermined. However, due to the dependency of the resonance frequency on different operating parameters, such as for example the temperature and filling pressure, there is the risk that the cooling device 20 is operated at a poor level of efficiency. For example, to this end FIG. 7 shows a possible connection between the stroke H and the cooling power K over the frequency f. As is visible, a maximum cooling power and stroke are in the range of a resonance frequency fo. Preferably, therefore, when regulating the piston stroke the resonance frequency of the reciprocating movement is determined by means of the regulating device 20 and the frequency of the reciprocating movement is set to this resonance frequency. As a result, the cooling device 20 may operate at an operating point with an optimal level of efficiency.

The resonance frequency may be determined and controlled using a connection between the resonance frequency and the operating parameters (for example the temperature) stored in the regulating device 40. Preferably, however, the resonance frequency is automatically regulated at an optimal value. To this end, by altering the target value fs for the frequency of the motor voltage automatically in specific temporal intervals at a constant predetermined amplitude of the motor voltage U the frequency fu of the motor voltage is varied to higher and lower frequencies by means of the regulating device 40 and thus the phase shift between the motor voltage U and the motor current I is determined. The resonance frequency is present when the phase shift is at a maximum.

To this end, the regulating device 40 receives measured values for the motor voltage U and the motor current I from the frequency converters 43 or the control and/or regulating unit 44 of the converters, and determines the phase shift. The phase shift may also be determined directly in the converters 43 or in the control and/or regulating unit 44, and be transmitted to the regulating device 40.

Alternatively, the resonance frequency may also be determined via the manipulated variable for regulating the piston stroke. The resonance frequency is the frequency at which the manipulated variable, in this case the motor voltage, is at its lowest.

Advantageously, when regulating the piston stroke, deviations and irregularities relative to a zero position of the pistons 31, for example due to an oblique position of the compressor 20, are taken into consideration by the regulating device 40. Said deviations and irregularities may, for example, be compensated by different target value settings for the two converters 43 (for example in the form of a direct voltage component in the motor voltage).

Additionally, the regulating device 40 may also comprise a further monitoring device which prevents the pistons striking against the housing walls and excessive motor currents by a reduction of the target value. To this end, extreme values measured by the measuring devices 37 are monitored by the regulating device 40 for exceeding a predetermined limit value.

The two linear motors 33 may also be supplied together by a single frequency converter 43. However, when regulating the piston stroke the two motors for compensating deviations and irregularities relative to a zero position of the pistons, for example when the compressor is inclined, are not actuated differently.

Figure 8:
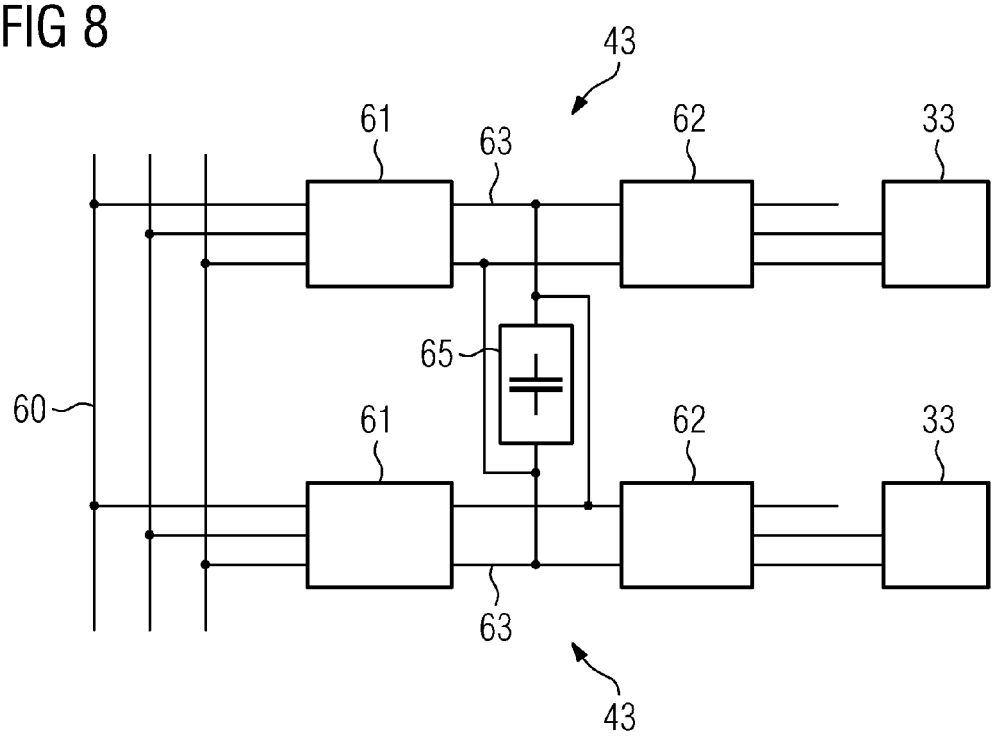
FIG. 8 shows an embodiment with two-phase motors and three-phase converters.

According to an embodiment shown in FIG. 8, the motors 33 are configured as two-phase AC motors. As the power supply systems in larger installations, such as for example in ships, are generally configured as three-phase AC networks 60, the frequency converters 43 are configured as three-phase converters with in each case a current converter 61 on the network side, a current converter 62 on the motor side and a voltage intermediate circuit 63 arranged therebetween, in order to ensure symmetrical loading of the network 60.

When using commercially available converters 43 there is the risk, however, that said converters recognize the two-phase loading of the intermediate circuit 63 as a phase failure on the network and therefore cut out. To remedy this, the intermediate circuit voltages of the two converters 43 are stabilized via an additional capacitor 64, which is arranged in parallel with the intermediate circuits 63 of the two converters 43.

The cooling power produced by the cooling device 20 has been able to be controlled or regulated by regulating the stroke. In this case, there is an enormous potential for saving the electrical power supplied, as the efficiency of a compressor is only approximately 1%. Commercially available compressors always run at full load, cooling power which is not required being compensated or dissipated by reheating. 1 W of dissipated cooling power corresponds in this case to 100 W dissipated power received from the power supply system. By the regulation and actuation according to the invention it is possible to keep the compressor at a fixed operating point, without temperature alterations or other operational effects (for example oblique positions of the compressor) leading to shifts of the operating point. Also, it is possible to prevent the pistons striking and thus the inevitable safety cut-outs of the compressor.

A fixedly set operating point may in this case be maintained even when the compressor is inclined and/or in an oblique position. This is an important prerequisite for the use of the compressor on ships. As designs which are suitable for the ship building industry are already available commercially for the components used for the regulation and actuation, therefore, a cooling device according to an embodiment of the invention may be designed which is eminently suitable for ships.

By automatically readjusting the operating frequency, the operating point of the compressor may be run increasingly close to the resonance point. As a result, it is possible to ensure that at any time the compressor is operated at the resonance point, i.e. has an optimal level of efficiency.

By way of a regulating device according to an embodiment of the invention, a plurality of compressors, which are operated as a group, may also be controlled or regulated in parallel. For example, for an HTS synchronous machine, up to four cooling devices (refrigerators) are required, of which for example two are provided as redundancy. Instead of allowing two such devices to run at full load, now all four may be run at partial load. As a result, all four devices are able to operate in a range which is advantageous for the level of efficiency.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for operating a cooling device for cooling a superconductor, the cooling device including a linear compressor for compressing a working medium and a cooling unit for discharging a cooling power to a cryogenic coolant of the superconductor by expanding the working medium, the linear compressor including at least two pistons, of which at least one of the pistons movable at a frequency and a stroke in a linear manner relative to a respective other one of the pistons, the stroke of the at least one movable piston being regulateable at a target value, the method comprising:

driving each of the at least one movable piston using a respective motor via a respective frequency converter for supplying the motor with electrical current at a voltage and frequency, the voltage applied to the respective motor being used as a manipulated variable for regulating a stroke of the at least one piston, the motors being configured as two-phase AC motors and the frequency converters being configured as three-phase converters with a voltage intermediate circuit, the frequency converters being connected on an input side to a three-phase network and on an output side via two phases to the respective motor, and an additional capacitor being arranged in parallel with the voltage intermediate circuits.

2. The method as claimed in claim 1, wherein the target value for the stroke is deduced from a target value for the cooling power and by regulating the stroke at a target value, the cooling power is at least one of controlled and regulated at said target value.

3. The method as claimed in claim 2, wherein, in two reciprocating pistons moving synchronously relative to one another in a linear manner, an average value from the stroke of the two pistons is used as a controlled variable for regulating the piston stroke.

4. The method as claimed in claim 1, wherein, when regulating the piston stroke, the frequency of the reciprocating movement is fixedly predetermined.

5. The method as claimed in claim 1, wherein, when regulating the piston stroke, a resonance frequency of the reciprocating movement is determined and the frequency of the reciprocating movement is set to the resonance frequency.

6. The method as claimed in claim 5, wherein the resonance frequency is determined via a phase shift between a motor current and a motor voltage or via a manipulated variable for regulating the piston stroke.

7. The method as claimed in claims 1, wherein, when regulating the piston stroke, deviations and irregularities relative to a zero position of the pistons are compensated.

8. The method as claimed in claim 2, wherein, when regulating the piston stroke, the frequency of the reciprocating movement is fixedly determined.

9. The method as claimed in claim 2, wherein, when regulating the piston stroke, a resonance frequency of the reciprocating movement is determined and the frequency of the reciprocating movement is set to the resonance frequency.

10. The method as claimed in claim 9, wherein the resonance frequency is determined via a phase shift between a motor current and a motor voltage or via a manipulated variable for regulating the piston stroke.

11. The method as claimed in claim 2, wherein, when regulating the piston stroke, deviations and irregularities relative to a zero position of the pistons are compensated.

12. A cooling device for cooling a superconductor comprising:

a linear compressor to compressing a working medium; and a cooling unit to discharge a cooling power to a cryogenic coolant of the superconductor by expanding the working medium, the linear compressor including at least two pistons, at least one of the at least two pistons being movable at a frequency and a stroke in a linear manner relative to a respective other piston; and a regulating device designed to regulates the stroke of the at least one movable piston at a target value, wherein the at least two pistons include two movable pistons and wherein, to drive each of the movable pistons, the cooling device comprises a respective electrical motor and a respective frequency converter to supply the respective motor with electrical current at a voltage and frequency, the two movable pistons each being drivable via one respective frequency converter by one respective electrical motor at a frequency-synchronous voltage, the motors being configured as two-phase AC motors and the frequency converters being configured as three-phase converters with a voltage intermediate circuit, wherein the converters on an input side being connected to a three-phase network and on an output side being connected via two phases to the respective motor, and wherein an additional capacitor is arranged in parallel with the voltage intermediate circuits.

13. The cooling device as claimed in claim 12, wherein data are stored in the regulating device which describe a connection between the cooling power and the piston stroke.

14. The cooling device as claimed in claim 12, further comprising:

at least one of a superimposed control and regulating device to at least one of control and regulate the cooling power target value by regulating the piston stroke.

15. The cooling device as claimed in claim 12, wherein the regulating device comprises a measuring device to measure the piston stroke of the at least one movable piston.

16. The cooling device as claimed in claim 12, wherein the regulating device is designed so that when regulating the piston stroke, the regulating device determines a resonance frequency of the reciprocating movement and sets the frequency of the reciprocating movement to said resonance frequency.

17. The cooling device as claimed in claim 12, wherein both of the pistons, synchronously each of the pistons relative to another of the pistons, are movable at a frequency and a stroke in a linear manner relative to one another of the pistons.

18. The cooling device as claimed in claim 13, further comprising:

at least one of a superimposed control and regulating device to at least one of control and regulate the cooling power at a target value by regulating the piston stroke.

19. The cooling device as claimed in claim 15, wherein the measuring device is a magnetic field sensor or an optical sensor.

* * * * *